US009145714B2

(12) United States Patent
Wineland

(10) Patent No.: US 9,145,714 B2
(45) Date of Patent: Sep. 29, 2015

(54) OUTBOARD MOTOR LOCK

(71) Applicant: Charles D. Wineland, Monroe, MI (US)

(72) Inventor: Charles D. Wineland, Monroe, MI (US)

( * ) Notice: Subject to any disclaimer, the term of this patent is extended or adjusted under 35 U.S.C. 154(b) by 65 days.

(21) Appl. No.: 13/870,973

(22) Filed: Apr. 25, 2013

(65) Prior Publication Data

US 2014/0319309 A1 Oct. 30, 2014

(51) Int. Cl.

*B63H 20/00* (2006.01)
*E05B 73/00* (2006.01)
*E05B 65/00* (2006.01)

(52) U.S. Cl.

CPC ..... *E05B 73/0076* (2013.01); *B63H 20/007* (2013.01); *E05B 65/00* (2013.01); *Y10T 29/49826* (2015.01)

(58) Field of Classification Search

CPC .... F02B 61/045; B63H 20/007; B63H 20/06; B63H 20/02; B63H 20/10; B63H 20/106; B63H 21/26; B63H 21/30; E05B 73/00; E05B 73/007; E05B 73/0076; E05B 65/00

USPC ..... 248/551, 552, 640, 641, 643, 642; 440/6, 7, 53–60; 114/144 R

See application file for complete search history.

(56) References Cited

U.S. PATENT DOCUMENTS

| | | | | |
|---|---|---|---|---|
| 2,930,341 | A * | 3/1960 | Gaston | 440/52 |
| 3,465,995 | A * | 9/1969 | Whitman | 248/228.3 |
| 4,863,132 | A * | 9/1989 | Fitzgerald et al. | 248/274.1 |
| 2010/0127150 | A1 * | 5/2010 | Wakeham | 248/642 |

* cited by examiner

*Primary Examiner* — Nkeisha Smith

(74) *Attorney, Agent, or Firm* — Charles D. Wineland, III

(57) ABSTRACT

In one embodiment, the outboard motor lock comprises an outboard motor lock bracket and an outboard motor lock securing mechanism. The bracket comprises a back plate, side plates and a lip, and may be attached to a boat hull or other surface through bracket attachment holes. The securing mechanism comprises a base and one or more securing rods. The securing mechanism can be inserted into the bracket by inserting the one or more securing rods through corresponding bracket securing holes. One or more aligned bracket locking holes and securing mechanism locking holes allow for a locking device to be passed through and lock the securing mechanism to the bracket. When the securing mechanism is inserted into the bracket after an outboard motor attaching mechanism has engaged the bracket, the securing mechanism prevents the attaching mechanism from being removed from the bracket.

10 Claims, 5 Drawing Sheets

OUTBOARD MOTOR LOCK

BACKGROUND OF THE INVENTION

This system relates to an outboard motor lock. More particularly, the lock assists in securing an outboard motor to the hull of a boat.

The design of most outboard motors facilitates easy attachment and removal from the hull of a boat. In addition to providing convenience for the boat owner, it also means that outboard motors can be easily targeted for theft while the boat is not in use. While likely no method of securing an outboard motor to a boat could fully prevent theft, an easy way to secure the motor and deter theft, while also providing beneficial protection to the boat hull itself, is desirable.

SUMMARY OF THE INVENTION

In one embodiment, the outboard motor lock comprises an outboard motor lock bracket and an outboard motor lock securing mechanism. The bracket comprises a back plate, side plates and a lip, and may be attached to a boat hull or other surface through bracket attachment holes. The securing mechanism comprises a base and one or more securing rods. The securing mechanism can be inserted into the bracket by inserting the one or more securing rods through corresponding bracket securing holes. One or more aligned bracket locking holes and securing mechanism locking holes allow for a locking device to be passed through and lock the securing mechanism to the bracket. When the securing mechanism is inserted into the bracket after an outboard motor attaching mechanism has engaged the bracket, the securing mechanism prevents the attaching mechanism from being removed from the bracket.

These and other features of the present invention can be best understood from the following specification and drawings, the following of which is a brief description.

DETAILED DESCRIPTION OF THE PREFERRED EMBODIMENT

Figure 1:
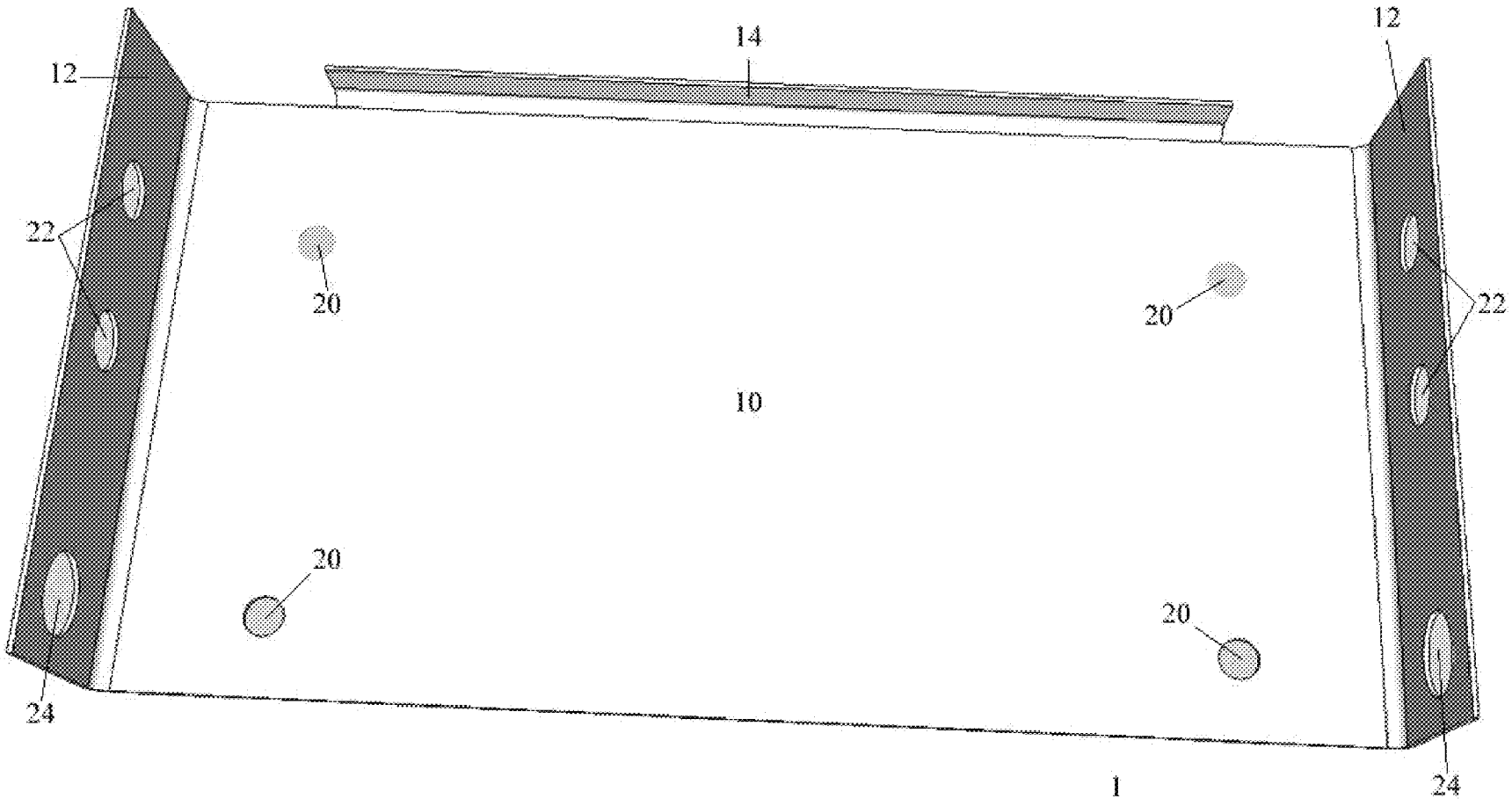
FIG. 1 schematically illustrates an example outboard motor lock bracket of the present invention.

FIG. 1 schematically illustrates an example outboard motor lock bracket 1. The bracket 1 comprises a back plate 10, side plates 12 and a lip 14. Bracket attachment holes 20 allow for the bracket 1 to be affixed to the hull of a boat, for instance the transom, or another surface. Attachment via the bracket attachment holes 20 can be achieved with screws, bolts or other methods of attachment. Bracket securing holes 22 allow for an outboard motor lock securing mechanism to be inserted into the bracket 1. Bracket locking holes 24 allow for the securing mechanism to be locked to the bracket 1.

The bracket may be constructed of stainless steel, or another material. It may be manufactured by stamping, forming, laser cutting, water jetting or welding, or by another method. Further, the bracket may be constructed out of one sheet of material, or out of multiple pieces.

Figure 2:
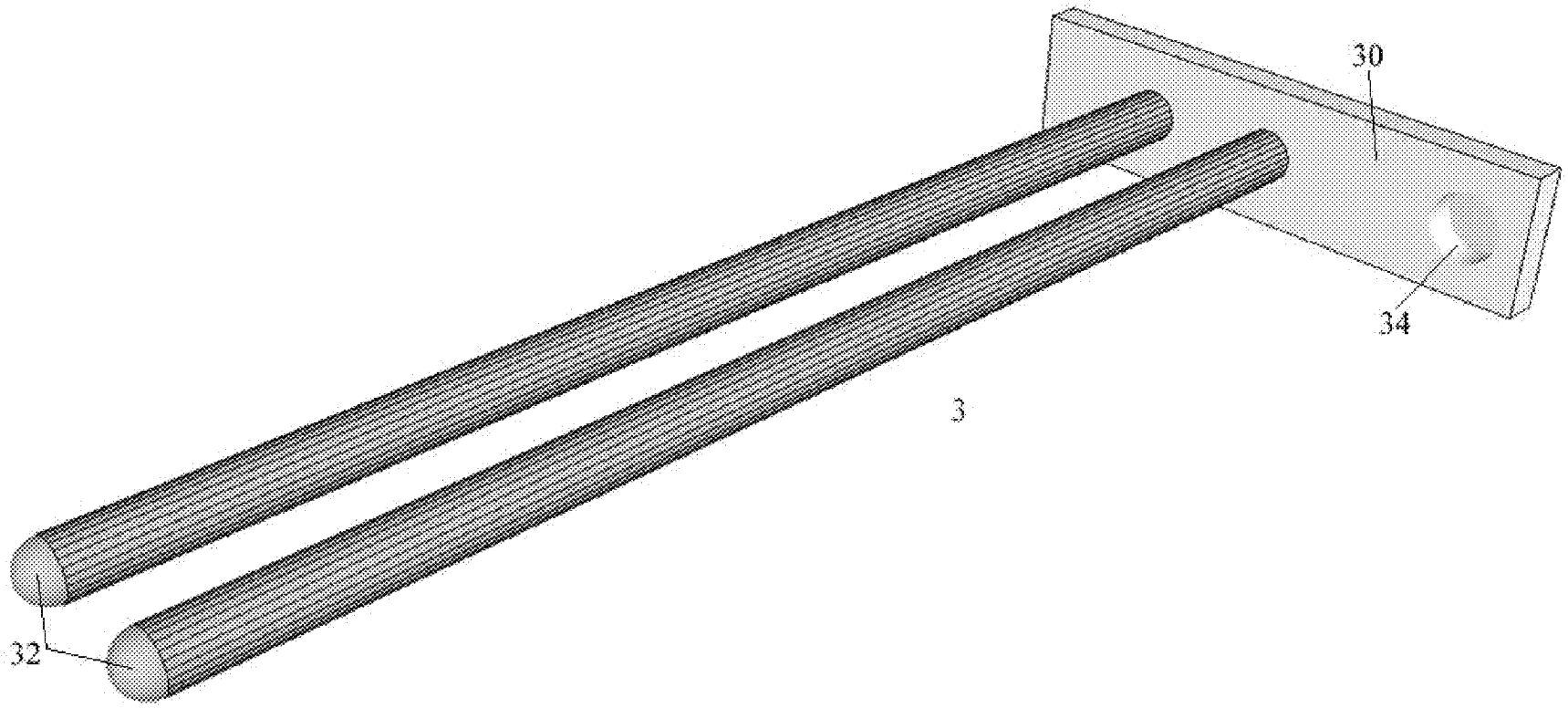
FIG. 2 schematically illustrates an example outboard motor lock securing mechanism of the present invention.

FIG. 2 schematically illustrates an example outboard motor lock securing mechanism 3. The securing mechanism 3 comprises a base 30 and one or more securing rods 32. One or more securing mechanism locking hole 34 allows for the securing mechanism 3 to be locked to an outboard motor lock bracket.

The securing mechanism 3 may be constructed of stainless steel, or another material. It may be manufactured by stamping, laser cutting, welding, extrusion or another process. The one or more securing rods 32 may be of circular cross section, or may have a cross section of another shape, such as a polygon.

Figure 3:
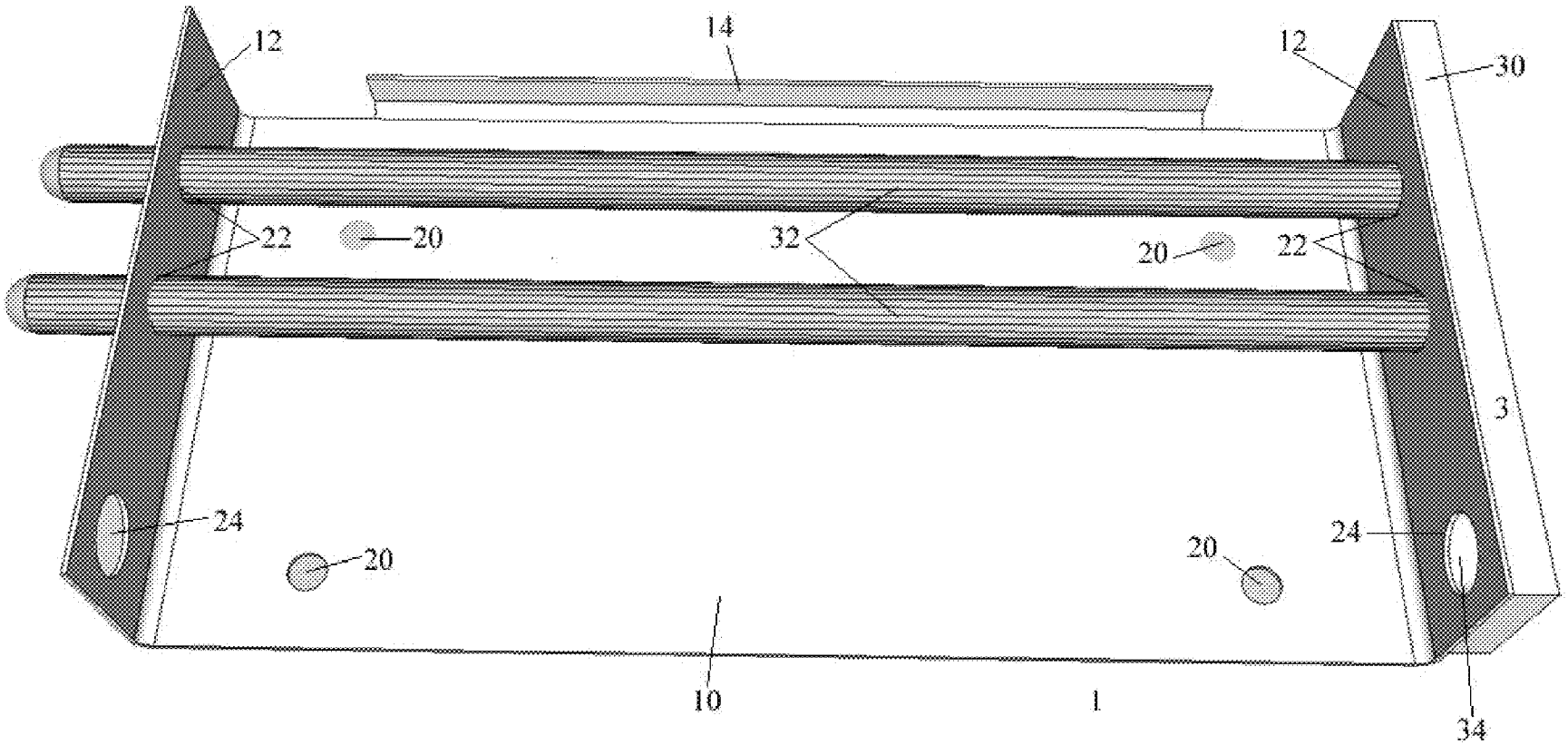
FIG. 3 schematically illustrates an example outboard motor lock securing mechanism inserted into an example outboard motor lock bracket of the present invention.

FIG. 3 schematically illustrates an example outboard motor lock securing mechanism 3 inserted into an example outboard motor lock bracket 1. The bracket 1 comprises a back plate 10, side plates 12 and a lip 14. Bracket attachment holes 20 allow for the bracket 1 to be affixed to the hull of a boat, for instance the transom, or another surface. Attachment via the bracket attachment holes 20 can be achieved with screws, bolts or other methods of attachment. Bracket securing holes 22 allow for the securing mechanism 3 to be inserted into the bracket 1. Bracket locking holes 24 allow for the securing mechanism 3 to be locked to the bracket 1. The securing mechanism 3 comprises a base 30 and one or more securing rods 32. One or more securing mechanism locking hole 34 allows for the securing mechanism 3 to be locked to the bracket 1.

The securing mechanism 3 can be inserted into the bracket 1 by inserting the one or more securing rods 32 through the bracket securing holes 22. The one or more securing rods 32 and corresponding bracket securing holes 22 may be of circular cross section, or may have a cross section of another shape, such as a polygon. Ideally the securing rods 32 should be long enough to fit through the bracket securing holes 22 on both sides of the bracket 1, but other configurations may be used. By aligning, the one or more securing mechanism locking hole 34 and corresponding bracket locking hole 24 allow for a locking device to be placed through both to prevent the securing mechanism 3 from being separated from the bracket 1. The locking device may be a padlock, combination lock or other device. By having bracket securing holes 22 and bracket locking holes 24 on both sides of the bracket 1, the securing mechanism 3 may be used ambidextrously, in that the securing mechanism 3 could be inserted through either side of the bracket 1. Such ambidextrous use is advantageous in that some boat setups might prevent the use of the securing mechanism 3 on one side of the bracket 1.

Figure 4:
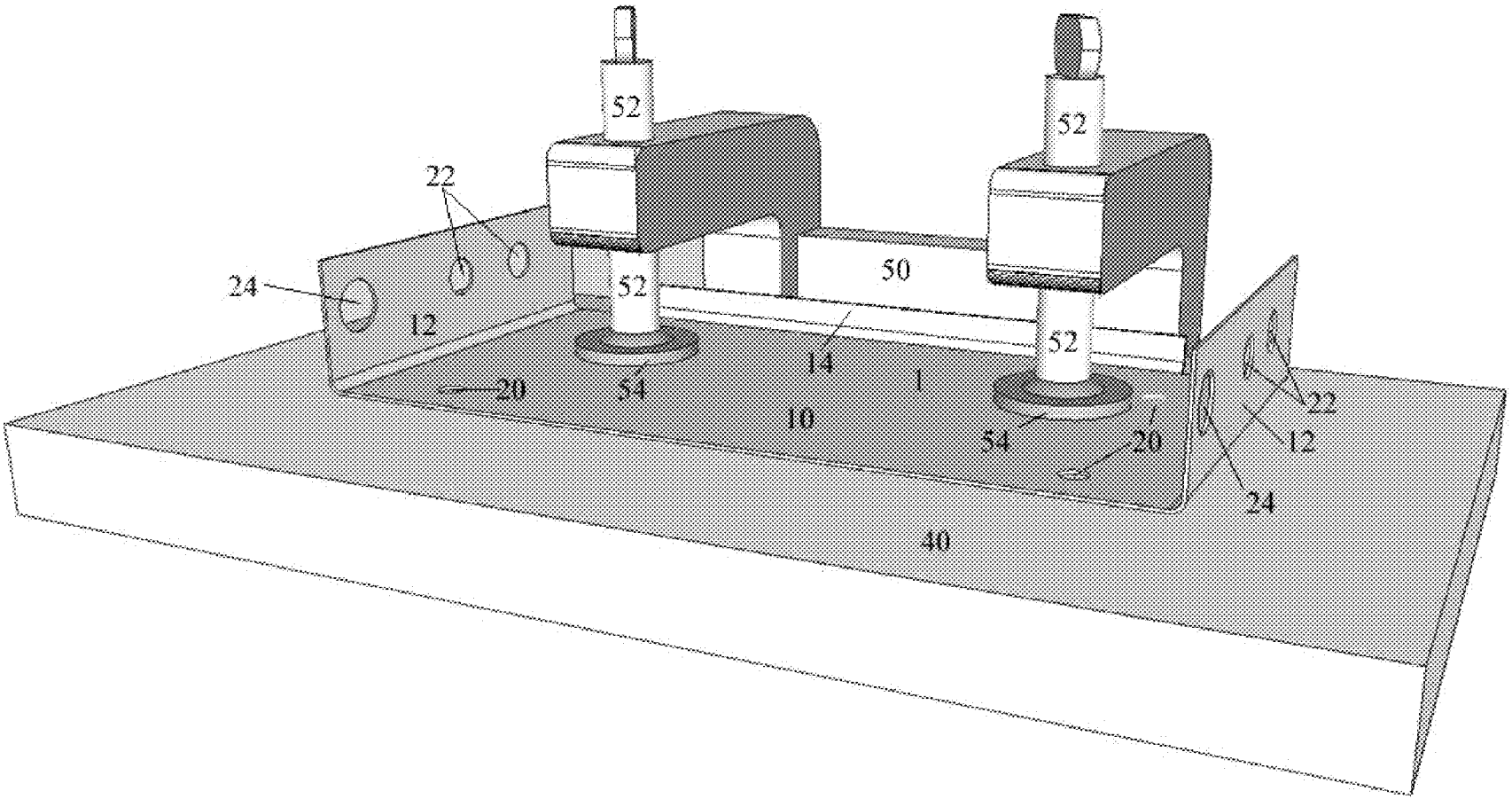
FIG. 4 schematically illustrates an example outboard motor lock bracket of the present invention attached to the hull of a boat, with an outboard motor attaching mechanism engaged.

FIG. 4 schematically illustrates an example outboard motor lock bracket 1 attached to the hull of a boat 40, with an outboard motor attaching mechanism 50 engaged. The bracket 1 comprises a back plate 10, side plates 12 and a lip 14. Bracket attachment holes 20 allow for the bracket 1 to be affixed to the hull of a boat 40, for instance the transom, or another surface. Attachment via the bracket attachment holes 20 can be achieved with screws or bolts into the hull 40, or other methods of attachment. Bracket securing holes 22 allow for an outboard motor lock securing mechanism to be inserted into the bracket 1. Bracket locking holes 24 allow for the securing mechanism to be locked to the bracket 1.

Frequently outboard motors utilize the outboard motor attaching mechanism 50 to secure the outboard motor. In many ways the attaching mechanism 50 resembles, and functions like, a C-clamp. The attaching mechanism 50 includes one or more tightening devices 52, such as bolts or other devices, and one or more contacting devices 54. By using the one or more tightening devices 52 to tighten the contacting devices 54 against a boat hull or other surface, the attaching mechanism 50 holds the outboard motor to the boat. Unfortunately, just as the tightening devices 52 can be tightened to hold the motor firm, they can also be loosened to allow the motor to be removed.

The attaching mechanism 50 can be placed over the bracket 1, such that the contacting devices 54 contact the bracket 1, such as on the back plate 10, instead of contacting the hull 40 directly. This provides the added benefit of protecting the hull 40, such as the transom which is often made of wood or other soft materials, from being damaged by the contact with the contacting devices 54, such as through over-tightening or general wear and tear. The bracket 1 can be positioned on the hull 40 such that the attaching mechanism 50 engages the bracket 1 properly. The lip 14 of the bracket 1 provides added benefit in that it prevents the motor from slipping off of the bracket 1 and/or hull 40 if the tightening devices 52 and corresponding contacting devices 54 become loose.

Figure 5:
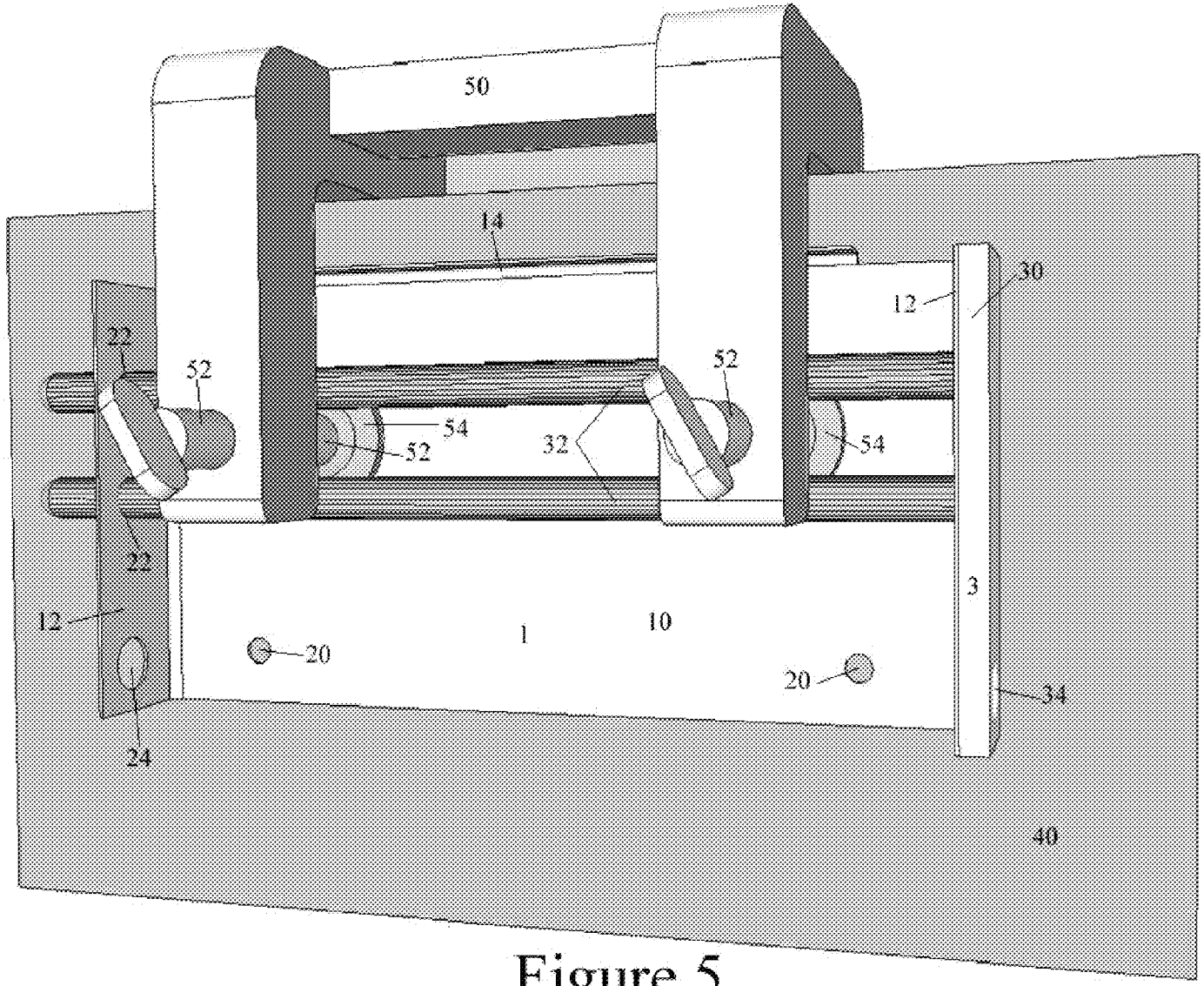
FIG. 5 schematically illustrates an example outboard motor lock bracket of the present invention attached to the hull of a boat, with an outboard motor attaching mechanism engaged and an outboard motor lock securing mechanism securing the outboard motor attaching mechanism in place.

FIG. 5 schematically illustrates an example outboard motor lock bracket 1 attached to the hull of a boat 40, with an outboard motor attaching mechanism 50 engaged and an outboard motor lock securing mechanism 3 securing the outboard motor attaching mechanism 50 in place. The bracket 1 comprises a back plate 10, side plates 12 and a lip 14. Bracket attachment holes 20 allow for the bracket 1 to be affixed to the hull of a boat 40, for instance the transom, or another surface. Attachment via the bracket attachment holes 20 can be achieved with screws or bolts into the hull 40, or other methods of attachment. Bracket securing holes 22 allow for the securing mechanism 3 to be inserted into the bracket 1. Bracket locking holes 24 allow for the securing mechanism 3 to be locked to the bracket 1. The securing mechanism 3 comprises a base 30 and one or more securing rods 32. One or more securing mechanism locking hole 34 allows for the securing mechanism 3 to be locked to the bracket 1.

The attaching mechanism 50 includes one or more tightening devices 52, such as bolts or other devices, and one or more contacting devices 54. By using the one or more tightening devices 52 to tighten the contacting devices 54 against a boat hull or other surface, the attaching mechanism 50 holds the outboard motor to the boat. The attaching mechanism 50 can be placed over the bracket 1, such that the contacting devices 54 contact the bracket 1, such as on the back plate 10, instead of contacting the hull 40 directly. This provides the added benefit of protecting the hull 40, such as the transom which is often made of wood or other soft materials, from being damaged by the contact with the contacting devices 54, such as through over-tightening or general wear and tear. The bracket 1 can be positioned on the hull 40 such that the attaching mechanism 50 engages the bracket 1 properly.

The securing mechanism 3 can be inserted into the bracket 1 by inserting the one or more securing rods 32 through the bracket securing holes 22. The one or more securing rods 32 and corresponding bracket securing holes 22 may be of circular cross section, or may have a cross section of another shape, such as a polygon. Ideally the securing rods 32 should be long enough to fit through the bracket securing holes 22 on both sides of the bracket 1, but other configurations may be used. By aligning, the one or more securing mechanism locking hole 34 and corresponding bracket locking hole 24 allow for a locking device to be placed through both to prevent the securing mechanism 3 from being separated from the bracket 1. The locking device may be a padlock, combination lock or other device. By having bracket securing holes 22 and bracket locking holes 24 on both sides of the bracket 1, the securing mechanism 3 may be used ambidextrously, in that the securing mechanism 3 could be inserted through either side of the bracket 1. Such ambidextrous use is advantageous in that some boat setups might prevent the use of the securing mechanism 3 on one side of the bracket 1.

When the securing mechanism 3 is inserted into the bracket 1 after the attaching mechanism 50 has engaged the bracket 1, the securing mechanism 3 serves to secure the attaching mechanism 50 in place. Spacing of the one or more securing rods 32, along with proper placement of the bracket 1 on the hull 40, allows the securing rods 32 to be inserted into the bracket 1 without interfering with the tightening devices. Yet once the securing mechanism 3 is inserted into the bracket 1, the spacing of the one or more securing rods 32 prevents the contacting devices 54 from being removed from the bracket 1. Also some space between the contacting devices 54 and bracket 1 may be allowed, it is likely not enough space to allow for removal of the attaching mechanism 50, and in any case the securing rods 32 should prevent the tightening devices 52 and contacting devices 54, and thus the attaching mechanism 50, from being removed from the bracket 1. The lip 14 of the bracket 1 provides added benefit in that it prevents the motor from slipping off of the bracket 1 and/or hull 40 if the tightening devices 52 and corresponding contacting devices 54 become loose. When the securing mechanism 3 is inserted into the bracket 1, the securing rods 32 likely do not allow enough separation between the bracket 1 and contacting devices 54 for the contacting devices 54 to pass over the lip 14, regardless of the presence of the securing rods 32 in keeping the tightening devices 52 in place.

The preceding description is exemplary rather than limiting in nature. Variations and modifications to the disclosed examples may become apparent to those skilled in the art that do not necessarily depart from the essence of this disclosure.

I claim:

1. An outboard motor lock in combination with an outboard motor comprising a bracket and a securing mechanism, wherein the bracket comprises a back plate and one or more side plates, and wherein the outboard motor is configured to attach to a front surface of the back plate and a boat hull is configured to attach to a rear surface of the back plate, and wherein the securing mechanism comprises a base and one or more securing rods; wherein the one or more side plates include one or more bracket securing holes operable to receive the one or more securing rods; wherein the one or more side plates further include a bracket locking hole, and wherein the securing mechanism includes a securing mechanism locking hole, such that the bracket locking hole and securing mechanism locking hole are operable to receive a locking device to lock the securing mechanism to the bracket; wherein the one or more side plates are two side plates; wherein each of the two side plates include the one or more bracket securing holes such that either side of the bracket is operable to receive the securing mechanism, via the one or more securing rods; and wherein each of the two side plates includes the bracket locking hole, such that either side of the bracket is operable to receive a locking device to lock the securing mechanism to the bracket.

2. The outboard motor lock of claim 1, wherein the one or more securing rods comprise two or more securing rods and the one or more bracket securing holes comprise two or more bracket securing holes.

3. The outboard motor lock of claim 1, wherein the bracket further comprises a lip.

4. The outboard motor lock of claim 1, wherein the bracket and securing mechanism are made of stainless steel.

5. A method of securing an outboard motor, comprising the steps of:

inserting a securing mechanism over outboard motor tightening devices located on the outboard motor and into a bracket, wherein the bracket comprises a back plate and one or more side plates, and wherein the outboard motor is configured to attach to a front surface of the back plate and a boat hull is configured to attach to a rear surface of the back plate, wherein the securing mechanism comprises a base and one or more securing rods, wherein the one or more side plates include one or more bracket securing holes operable to receive the one or more securing rods, wherein the one or more side plates are two side plates, and wherein each of the two side plates include the one or more bracket securing holes such that either side of the bracket is operable to receive the securing mechanism, via the one or more securing rods, by inserting the one or more securing rods into one or more corresponding bracket securing holes; and locking the securing mechanism to the bracket, wherein the one or more side plates further include a bracket locking hole, wherein the securing mechanism includes a securing mechanism locking hole, such that the bracket locking hole and securing mechanism locking hole are operable to receive a locking device to lock the securing mechanism to the bracket, and wherein each of the two side plates includes the bracket locking hole, such that either side of the bracket is operable to receive a locking device to lock the securing mechanism to the bracket, by inserting the locking device through the securing mechanism locking hole and a corresponding bracket locking hole.

6. The method of claim 5, further comprising the step of attaching the outboard motor to the boat hull by positioning an outboard motor attaching mechanism over the bracket and tightening outboard motor contacting devices against the bracket.

7. The method of claim 6, further comprising the step of attaching the bracket to the boat hull via bracket attachment holes.

8. The method of claim 5, wherein the step of inserting a securing mechanism over the outboard motor tightening devices and into the bracket may be accomplished by inserting the one or more securing rods into the one or more corresponding bracket securing holes on either side of the bracket.

9. The method of claim 8, wherein the step of locking the securing mechanism to the bracket may be accomplished by inserting the locking device through the securing mechanism locking hole and the corresponding bracket locking hole on either side of the bracket.

10. An outboard motor lock in combination with an outboard motor comprising a bracket and a securing mechanism, wherein the bracket comprises a back plate, two side plates and a lip, and wherein the outboard motor is configured to attach to a front surface of the back plate and a boat hull is configured to attach to a rear surface of the back plate, and wherein the securing mechanism comprises a base and two securing rods, wherein each of the two side plates includes two bracket securing holes operable to receive the two securing rods such that either side of the bracket is operable to receive the securing mechanism, via the two securing rods, wherein each of the two side plates further include a bracket locking hole, and wherein the securing mechanism includes a securing mechanism locking hole, such that either one of the bracket locking holes and the securing mechanism locking hole are operable to receive a locking device to lock the securing mechanism to the bracket, and wherein the bracket and securing mechanism are made of stainless steel.

* * * * *